US005301770A

United States Patent [19]

Regan et al.

[11] Patent Number: 5,301,770

[45] Date of Patent: Apr. 12, 1994

[54] ADJUSTABLE WORK PLATFORM ASSEMBLY

[76] Inventors: Timothy J. Regan, 10 Twinleaf Ct., Cockeysville; Albert J. Conners, 300 E. Joppa Rd., both of Towson, Baltimore, Md. 21204-3048

[21] Appl. No.: 909,179

[22] Filed: Jul. 6, 1992

[51] Int. Cl.[5] ..... E04G 3/10

[52] U.S. Cl. ..... 182/128; 182/142; 182/223; 182/150

[58] Field of Search ..... 182/128, 150, 113, 62.5, 182/142, 145, 223

[56] References Cited

U.S. PATENT DOCUMENTS

| | | | |
|---|---|---|---|
| 622,666 | 4/1899 | Burwell . | |
| 737,377 | 8/1903 | England . | |
| 982,905 | 1/1911 | Tilley . | |
| 1,864,934 | 6/1932 | Reeves . | |
| 3,033,389 | 5/1962 | Abarotin et al. . | |
| 3,436,120 | 4/1969 | Armstrong | 182/128 X |
| 3,556,252 | 1/1971 | Atkins | 182/128 |
| 3,817,348 | 6/1974 | Jones . | |
| 3,994,365 | 11/1976 | Petermann et al. | 182/128 X |
| 4,068,895 | 1/1978 | Reese et al. | 182/128 |
| 4,165,799 | 8/1979 | Munoz | 182/128 |

FOREIGN PATENT DOCUMENTS

| | | | |
|---|---|---|---|
| 9147 | of 1912 | United Kingdom | 182/223 |

*Primary Examiner*—Alvin C. Chin-Shue

*Attorney, Agent, or Firm*—Finnegan, Henderson, Farabow, Garrett & Dunner

[57] ABSTRACT

A moveable work platform assembly is provided which can be used, for example, within an enclosure having substantially nonvertical interior walls, the enclosure having a attachment means at substantially the upper end thereof. The moveable work platform assembly includes a main platform, suspension means for suspending the main platform from the attachment means, and at least one movable platform for extending outward relative to said main platform toward the interior wall of the enclosure and for retracting inward relative to said main platform and away from the interior wall of the enclosure.

17 Claims, 4 Drawing Sheets

ADJUSTABLE WORK PLATFORM ASSEMBLY

BACKGROUND OF THE INVENTION

The present invention relates to an adjustable work platform assembly and, in particular, to such a work platform assembly useful in an enclosure having substantially non-vertical walls.

In the construction arts, and in particular in the construction of large structures, it is often necessary to gain access to many parts of the structures, both inside and outside. To address this need, many devices have hitherto been provided, including cranes and scaffolding. Cranes, in particular the familiar "cherry picker" type, have the advantage of being able to bring a laborer, tools, and any necessary parts or materiel quickly to a point where work is to be performed. Their principal disadvantage is the relatively small size of the work platform assembly which limits their applicability to jobs wherein the number of workers is small (one or two, typically) and wherein the need for tools and materiel to perform the job is limited. Moreover, cranes typically have applicability only to where a job is to be performed on the outside of a structure.

Scaffolding can be applied to the outside or inside of a structure and can be so constructed so as to provide a platform which will accommodate a large number of workers and any desired amount of tools and materiel. One disadvantage to scaffolding is its cost to install and dismantle once the job is done.

SUMMARY OF THE INVENTION

In accordance with the present invention, a moveable work platform assembly capable of being suspended from attachment means comprises a main platform, suspension means for suspending the main platform from the attachment means, and at least one adjustable platform. Extension means are provided for extending the adjustable platform outward relative to the main platform and for retracting the adjustable platform inward relative to the main platform.

In another aspect of the present invention, a moveable work platform assembly is provided for use within an enclosure having substantially non-vertical interior walls. The enclosure has attachment means at substantially its upper end and the moveable work platform assembly includes a main platform, suspension means for suspending the main platform from the attachment means and at least one movable platform. Extension means are provided for extending the movable platform outward relative to the main platform and toward the interior wall of the enclosure and for retracting the movable platform inward relative to the main platform and away from the interior wall of the enclosure.

In yet another aspect of the work platform assembly of the present invention, first and second adjustable platforms are provided. First roller means are disposed in the main platform for supporting the first adjustable platform and second roller means are disposed in the main platform for supporting the second adjustable platform. The first adjustable platform is adjustable from a first position, wherein at least a part of the first adjustable platform is disposed within the main platform, to a second position, wherein the first adjustable platform is moved relative to the main platform and outward from the first position. The second adjustable platform is adjustable from a first position, wherein at least a part of the second adjustable platform is disposed within the main platform, to a second position, wherein the second adjustable platform is moved relative to the main platform and outward from the first position.

It is to be understood that both the foregoing general description and the following detailed description are exemplary and explanatory only and are not restrictive of the invention, as claimed.

BRIEF DESCRIPTION OF THE DRAWING

The accompanying drawings, which are incorporated in and which constitute a part of the specification, illustrate at least one embodiment of the invention and, together with the description, explain the principles of the invention.

DESCRIPTION ON THE PREFERRED EMBODIMENTS

Reference will now be made in detail to the presently preferred embodiments of the invention, examples of which are illustrated in the accompanying drawings. Wherever possible, the same reference numbers will be used throughout the drawings to refer to the same or like parts.

Figure 1:
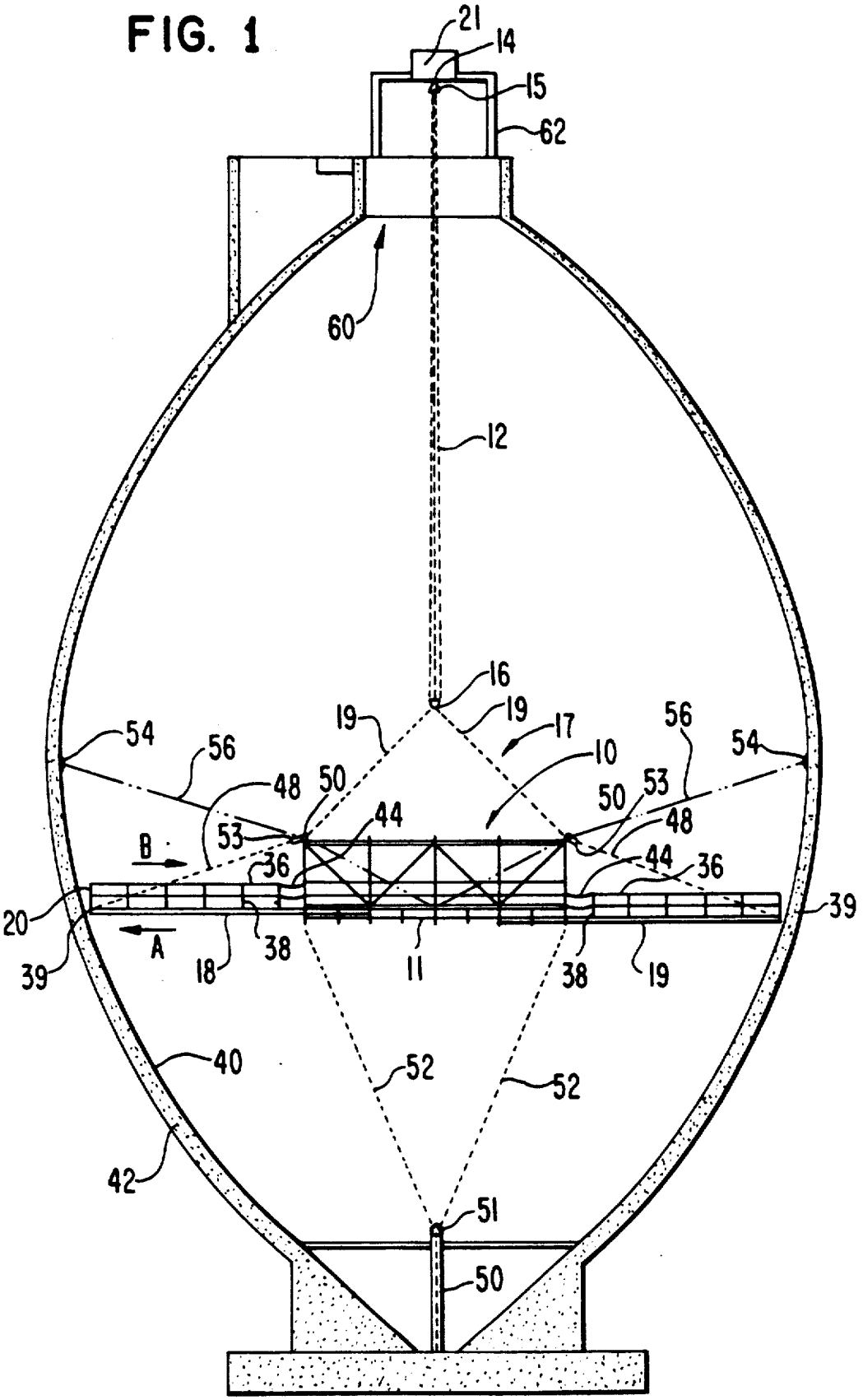
FIG. 1 is a front elevation view of a moveable work platform assembly in accordance with the present invention disposed in a structure having non-vertical walls.
Figure 2:
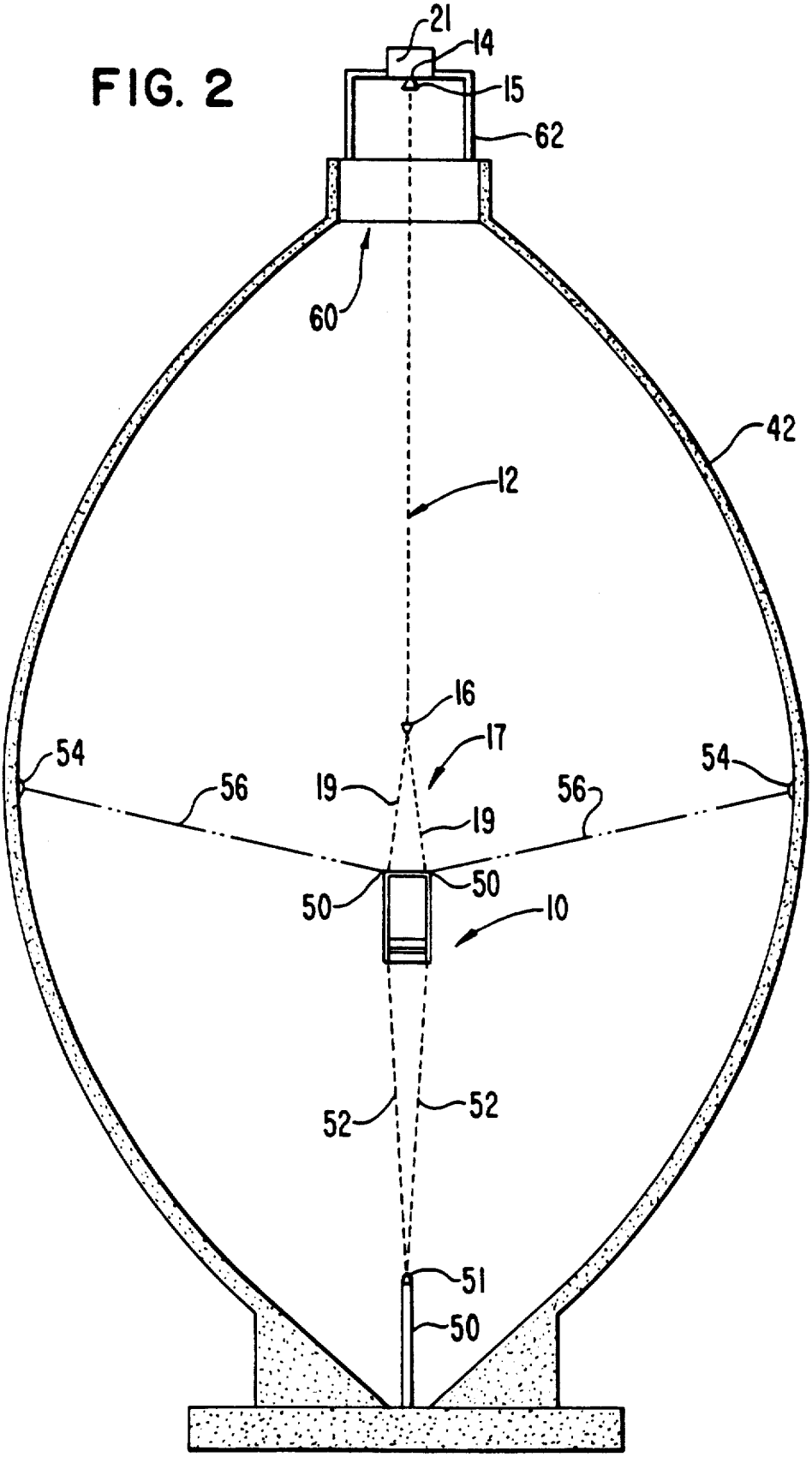
FIG. 2 is a side elevation view of a moveable work platform assembly in accordance with the present invention disposed in a structure having non-vertical walls.

A moveable work platform assembly in accordance with the present invention may find application in a number of environments, including in association with the exterior of structures such as buildings wherein the walls to be accessed by the platform are substantially perpendicular. Such a structure is well-known and is not further illustrated here. In addition, a moveable work platform assembly in accordance with the present invention may be used in association with structures wherein the walls are substantially non-vertical. Such a structure may be, for example, a digester tank for use in the art of sewage digestion such as illustrated in FIGS. 1 and 2. Such digester tanks may be, as shown in FIGS. 1 and 2, substantially egg-shaped.

A moveable work platform assembly in accordance with the present invention may be used in association with other structures having walls which are substantially non-vertical, such as, for example, hyperbolic shaped structures. Such hyperbolic structures include cooling towers, such as those commonly employed in nuclear power plants.

Thus, while the description that follows makes reference to the moveable work platform assembly in accordance with the present invention used in the interior of the egg-shaped enclosure of FIGS. 1 and 2, it should be understood that it is not the intention of the present inventors to so limit the scope of the invention or of its applicability.

FIG. 1 is a side elevation view of a moveable work platform assembly in accordance with the present invention which is capable of being suspended from attachment means. FIG. 2 is a front view of a moveable work platform assembly in accordance with the present invention. Both FIGS. 1 and 2 show a moveable work platform assembly 10 which is suspended through suspension means 12 from attachment means 14. Suspension means 12 can be of any suitable material and configuration and can be, for example, made of wire rope, chain, or cable. Attachment means 14 can be of any suitable structure and composition to ensure the moveable work platform assembly 10 remains attached, through suspension means 12, to the structure.

It may be desirable in some applications to ensure that a moveable work platform assembly in accordance with the present invention can rotate about attachment means 14. Accordingly, it may be desirable to provide swivel means disposed between the wire rope and said main platform for allowing said main platform to rotate relative to the attachment means. Such swivel means may include first swivel means 15 and/or second swivel means 16 located at either end of the suspension means 12. First and/or second swivel means, 15 and 16, respectively, useful in a moveable work platform assembly in accordance with the present invention may be embodied as, for example, swivels used in association with crane hooks. Such swivels are also known as "eye & eye" swivels.

A moveable work platform assembly in accordance with the present invention may also include secondary suspension means disposed between the swivel and the main platform. As shown in FIGS. 1 and 2, secondary suspension means 17 may include a plurality of, preferably, flexible connectors 19. It has been found to be advantageous to provide four such flexible connectors 19 connected at the corners of a truss structure 46 (described more fully below) through fixing means 50 (described move fully below). The configuration of four flexible connectors 19 as shown in FIGS. 1 and 2 can be characterized as a four-way bridle and has the advantage of increasing the stability of the moveable work platform assembly when it is suspended through suspension means 12 from attachment means 14.

A moveable work platform assembly in accordance with the present invention may also include elevating means for elevating and lowering the main platform relative to attachment means 14. FIG. 1 and 2 show elevating means 21 in schematic form. Elevating means 21 in accordance with the present invention may be embodied as, for example, a pneumatic hoist or an electric hoist.

Further, a moveable work platform assembly in accordance with the present invention includes at least one adjustable platform for extending outward relative to the main platform and for retracting inward relative to the main platform. FIG. 1 shows a moveable work platform assembly 10 in accordance with the present invention which includes a main platform 11 and a first adjustable platform 18 and second adjustment platform 19. It should be understood, however, that while FIG. 1 shows two adjustable platforms 18 and 19, a moveable work platform assembly in accordance with the present invention need only include one adjustable platform, depending on the specific application of the moveable work platform assembly in accordance with the present invention.

An adjustable platform in accordance with the present invention, such as, for example, first adjustable platform 18, is capable of extending in a direction outward relative to the main platform 11 as indicated by the arrow labeled "A" in FIG. 1 and inward relative to the main platform 11 as indicated by the arrow labeled "B" in FIG. 1.

In order to make the movement of the adjustable platform 18 easier, roller means may be provided between the adjustable platform 18 and the main platform 11 for rolling the adjustable platform 18 inward and outward relative to the main platform 18. In one aspect of the present invention, where the moveable work platform assembly 10 includes first and second adjustable platforms, 18 and 19, respectively, first roller means are provided in main platform 11 for supporting first adjustable platform 18 and second roller means disposed in main platform 11 for supporting second adjustable platform 19.

Figure 3:
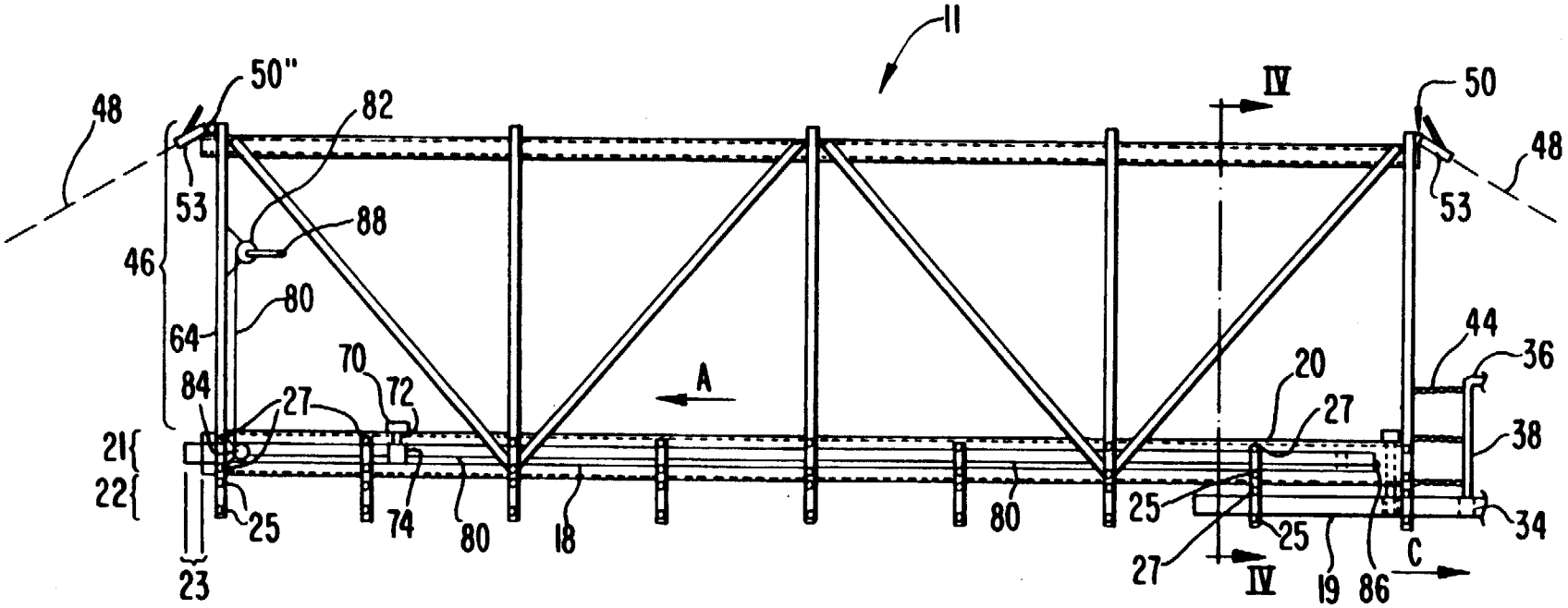
FIG. 3 is a front elevation view of a moveable work platform assembly in accordance with the present invention.

FIG. 3 is a front elevation view of a moveable work platform assembly in accordance with the present invention. In particular, FIG. 3 shows an example of an arrangement of main platform 11, first adjustable platform 18 and second adjustable platform 19. In one aspect of the present invention, the first adjustable platform is adjustable from a first position, wherein at least a part of the first adjustable platform is disposed within the main platform, to a second position, wherein the first adjustable platform is moved relative to the main platform and outward from the first position. Similarly, the second adjustable platform is adjustable from a first position, wherein at least a part of the second adjustable platform is disposed within the main platform, to a second position, wherein the second adjustable platform is moved relative to the main platform and outward from the first position.

Referring to FIG. 3, it can be seen that the first adjustable platform 18 is in a first position wherein at least a part of the second adjustable platform is disposed within main platform 11. As used herein, a part of an adjustable platform is "disposed within main platform 11" when that part lies below a top surface 20 of main platform 11. Stated another way, as shown in FIG. 3, a portion, designated as item 23, of first adjustable platform 18, extends beyond main platform 11. That portion 23 of first adjustable platform 18 is not disposed within main platform 11.

It should be understood that the size of portion 23 shown in FIG. 3 is for the purpose of illustration only. Portion 23 may be proportionately larger than that shown in FIG. 3 in some applications when the adjustable platform or platforms are in the first position. It should be understood, moreover, that for an adjustable platform to occupy a "first position" it need not have a portion 23 extending beyond main platform 11 as shown in FIG. 3. Indeed, it may be desirable in some applications to have the entirety of the adjustable platform or platforms disposed within the main platform when occupying the first position.

Second adjustable platform 19 has been moved to a second position, wherein second adjustable platform 19 has been moved outward, in the direction of arrow "C," from a first position. Again, such a "first position" is shown in FIG. 3 to be occupied by first adjustable platform 18.

Figure 4:
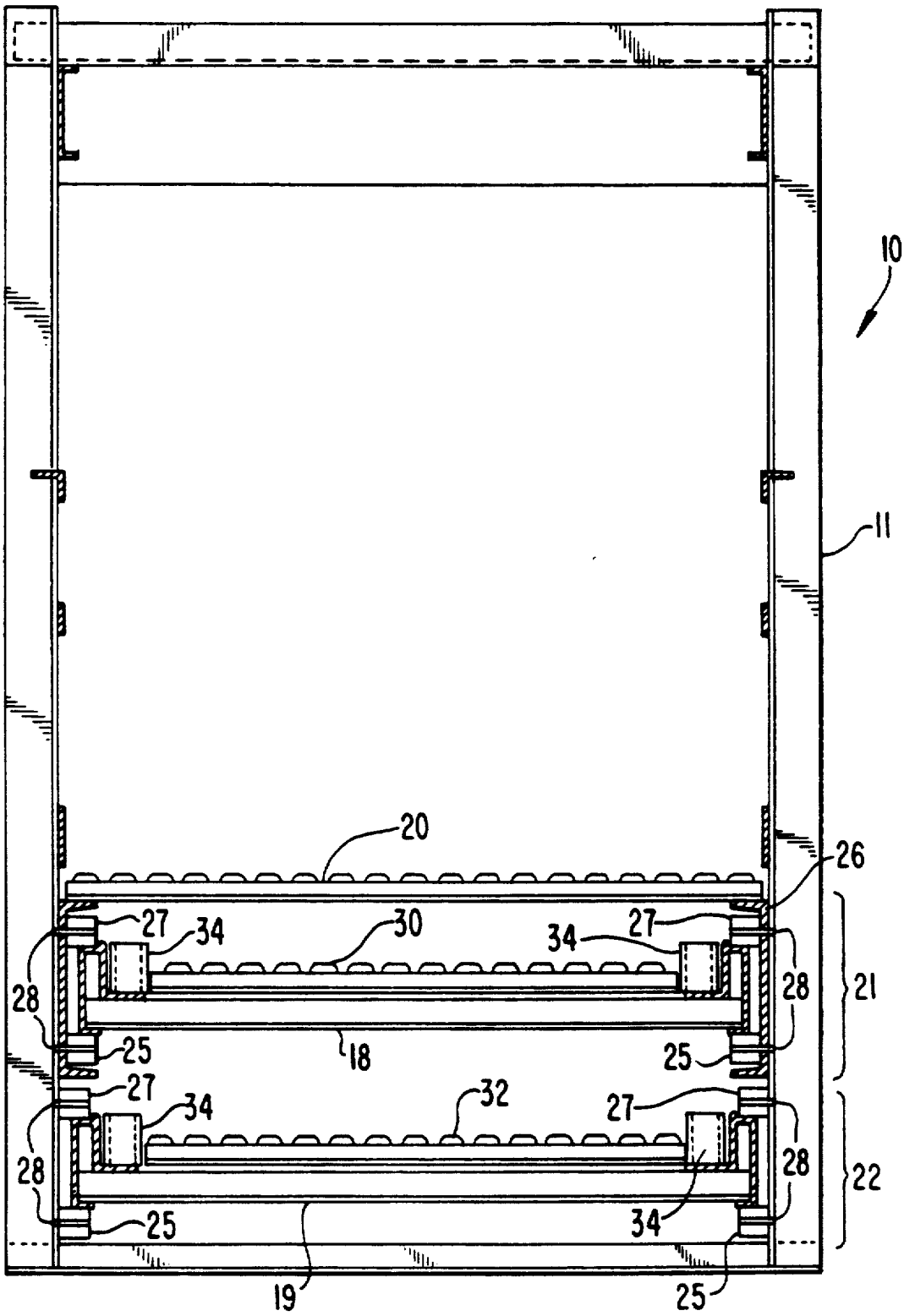
FIG. 4 is a cross-sectional view, taken along section line IV—IV of FIG. 3, of a moveable work platform assembly in accordance with the present invention.

FIG. 4 is a cross-sectional view of a moveable work platform assembly in accordance with the present invention taken along sectional line IV—IV of FIG. 3. Roller means, such as first roller means 21 are shown in FIG. 4 and may include, for example, a plurality of opposed rollers which may include, for example, a plurality of top rollers 27 and a plurality of bottom rollers 25. The top rollers 27 and bottom rollers 25 may be mounted, for example, to main platform 11 through axles 28.

Individual to and bottom rollers, 27 and 25, respectively, may be embodied, for example, as Camrol steel roller bearings, available from Bearings, Inc. of Baltimore, Md., U.S.A.

First roller means 21 are associated with first adjustable platform 18 and second roller means 22 are associated with second adjustable platform 19. In particular, and as shown in FIG. 3, first roller means 21 are distributed along the length of main platform 11 and below the top surface 20 thereof. Also as shown in FIG. 3, first roller means 21 supports first adjustable platform 18 in the manner described below. Similarly, second roller means 22 are shown in FIG. 3 as being distributed along the length of main platform 11 and below top surface 20 and below first roller means 21. Second roller means 22 supports second adjustable platform 19 in the manner described below.

In the case of first roller means 21 associated with first adjustable platform 18, axles 28 are fixed to support means 26 for top surface 20 of main platform 11. Such support means 26 may be, as shown in FIG. 4, a channel beam.

The bottom rollers 25 support the adjustable platforms 18 and 19 and allows them to be extended outward, or retracted inward, in the manner discussed above. The top rollers 27 serves to restrict the rotation of adjustable platforms 18 and 19. Thus, as adjustable platforms 18 and/or 19 are extended outward, they will not rotate or sag such that they remains in substantially the same plane through the full extent of their extension.

In the present invention, the main platform includes a top surface. FIG. 4 is a cross-sectional view of adjustable work platform assembly 10, including a cross-sectional view of top surface 20. It should be understood that top surface 20 may extend the entire length of main platform 11. Top surface 20, is, for example, as shown in FIG. 4, mounted to main platform 11 through support means 26 in the form of a channel beam. Preferably, top surface is so mounted through welding. Top surface 20 is a surface which holds workers, tools, materiel and the like when a moveable work platform in accordance with the present invention is used. The first roller means are preferably below the top surface at a first level and the second roller means are at a second level below the first level.

Preferably, the first and second adjustable platforms include first and second top surfaces, respectively. Moreover, preferably, the first and second adjustable platforms include removable hand-rail means. Adjustable platforms 18 and 19 include top surfaces 30 and 32, respectively, to, as described above in reference to top surface 20 of main platform 11, provide a surface for workers, tools and materiel to be situated when moveable work platform assembly 10 is in use.

The first and second adjustable platforms, 18 and 19 respectively, include removable hand-rail means. The removable hand-rail means include, as shown in FIG. 4, hand-rail receptacles 34 and, as shown in FIG. 1, hand-rail section 36. Each of the hand-rail sections 36 includes upright portions 38. With reference to adjustable platform 18, it can be appreciated upon reference to FIGS. 1 and 4 that the hand-rail receptacles 34 are, preferably, hollow cylinders and that upright portions 38 are, preferably, tubular. The inner diameter of hand-rail receptacles 34 are preferably larger than the outer diameter of upright portions 38 such that hand-rail sections 36, through upright portions 38, may be easily inserted into and removed from handrail receptacles 34.

Thus, as adjustable platform 18 is moved outward relative to main platform 11 (the direction of arrow "A" of FIG. 1) hand-rail sections 36 may be inserted into hand-rail receptacles 34. As shown in FIG. 1 there are five such hand-rail sections 36 that have been inserted into hand-rail receptacles 34 of first adjustable platform 18.

It can be appreciated, upon reference to FIG. 1, in particular, that first adjustable platform 18 may be extended outward relative to main platform 11 to an extent that its end 39 is in engagement with the inner wall 40 of the enclosure 42. As indicated previously, such an extension may require that a plurality of hand rail sections 36 be inserted in hand-rail receptacles 34.

It may be that the extension of first adjustable platform 18 is insufficient to allow a last hand rail section 36 to be inserted. Accordingly, flexible hand-rail means 44 are provided which, as shown in FIG. 1, span the distance between main platform 11 and the last hand rail section 36. As shown in FIG. 1, and in FIG. 3 in reference to second adjustable platform 19, such flexible hand-rail means 44 may be lengths of chain which are removably attached to main platform 11 at one end and to the last hand rail section 36 on the other.

It can be appreciated that the hand-rail receptacles 34, hand rail sections 36, hand-rail uprights 38 and flexible hand-rail means 44 associated with second adjustable platform 19 may have the same structure and function in the same way as the corresponding elements associated with first adjustable platform 18, as described above.

The main platform preferably includes a truss structure. As shown in FIG. 3, main platform 11 includes a truss structure 46. Truss structure 46 provides the necessary stiffness to main platform 11 to hold the workers, tools, and materiel for a particular application. Moreover, it is to be designed to provide the necessary stiffness to support adjustable platforms 18 and 19 when operated in the manner described herein.

The moveable work platform assembly preferably includes support cables from the truss structure cage to the adjustable platform. As shown in FIG. 1 a support cable 48 is provided between the truss structure 46 of main platform 11 and first moveable platform 18. The purpose of support cable 48 is to support, for example, first adjustable platform 18 so that the end 39 of the first adjustable platform 18 does not sag. Stated another way, support cable 48 ensures that first adjustable platform 18 remains in substantially the same plane throughout its extension from the first position, substantially within main platform 11, to the second position. Similarly, a support cable 48 may be provided between the truss structure 46 of main platform 11 and second moveable platform 19 and has the same structure and method of operation as that described in reference to support cable 48 used in connection with first moveable platform 18.

As shown in FIG. 1, and in FIG. 3 in the case of second adjustable platform 19, support cable 48 is removably fixed to main platform 11 through removable fixing means 50. The removable fixing means 50 allow support cable 48 to be removed when not in use, such as when adjustable platform 18 is in a first position wherein it is disposed substantially within main platform 11. Similarly, though not shown in the drawings, removable fixing means are also provided on adjustable platform 18 so that, as described in reference to removable fixing means 50, support cable 48 can be removed when not in use. The point of attachment of removable fixing means 50 to main platform 11 is chosen to be sufficiently high so that it is above the height of an average worker. Clearly, then, the height of truss structure 46 is preferably at least the height of an average worker. By setting the position of removable fixing means 50 at that level, a minimum of interference by support cable with actions of workers using adjustable work platform assembly 10 is experienced.

Length adjustment means are provided to adjust the length of support cable 48 as adjustable platform 18 is extended outward relative to main platform 11. Length adjustment means 53 in accordance with the present invention are shown schematically in FIGS. 1 and 3 and may be embodied as, for example, a conventional hand-crank type of cable winch.

It is contemplated that a moveable work platform assembly in accordance with the present invention would be secured to the structure with which it is used in such a manner to provide safe and easy operation. Thus, various support means, including support cables may be envisioned through which the moveable work platform assembly may be secured to the structure with which it is used to prevent unwanted horizontal or vertical movement, tilting, swaying or other such movement.

The moveable work platform assembly of the present invention may include a pivot column disposed substantially on the bottom of the enclosure and support means provided which connect the main platform and the pivot column. FIGS. 1 and 2 show a pivot column 50 disposed on the bottom of enclosure 42. Preferably, pivot column 50 includes pivot means 51 which can rotate 360°. Pivot means in accordance with the present invention may be embodied as, for example, swivels used in association with crane hooks. As indicated above, such swivels may also be referred to as "eye & eye" swivels.

Support means 52 are provided which attach the pivot means 51 to main platform 11. Support means 52 in accordance with the present invention may be embodied as, for example, wire rope cables and are preferable attached to the four corners of main platform 11. Preferably, support means 52 include winch means, not shown, at each of the points of attachment of support means 52 to main platform 11. Such winch means allow the support means to be tightened so that a substantially fixed relation of the main platform 11 to the pivot means 51 and, therefor, to the enclosure 42, can be maintained. Such support means 52, and particularly when tightened as described above, ensure not only a substantially fixed vertical position of main platform 11, but also that main platform 11 does not tilt or sag at either end thereof. Thus, the vertical position of moveable work platform assembly 10 can be fixed relative to enclosure 42, and, in particular, relative to attachment means 14, while, through the operation of pivot means 51, moveable work platform assembly 10 may be rotated 360° so as to bring the end 39 of adjustable platform 18 into engagement with any desired portion of interior surface 40 of enclosure 42.

Moreover, the interior walls of the enclosure may include support points, such as support point 54 shown in FIGS. 1 and 2. Support cables, such as support cable 56 shown in FIGS. 1 and 2, may then be attached to the support points 54 at one end thereof and to the moveable work platform assembly, preferably the main platform, at the other end. Support cable 56 may be embodied as, for example, a metal cable or rope. The support points may be embodied as, for example, conventional eye bolts. Support cable 56 may be used, where necessary, to prevent the nuisance rotation of a moveable work platform assembly in accordance with the present invention.

A method of use of a moveable work platform assembly in accordance with the present invention will now be described. Referring to FIGS. 1 and 2, it can be seen that the opening 60 through which moveable work platform assembly 10 is to be introduced is small relative to the overall size of moveable work platform assembly 10 when first and second adjustable platforms are extended outward. Accordingly, it is necessary that the dimension of moveable work platform assembly 10 which is presented to and inserted through opening 60 is no larger than the diameter of opening 60.

One manner of achieving such a condition is to retract both first and second adjustable platforms, 18 and 19, respectively, to their "first" positions, as that term is defined above. Preferably, the "first" position occupied by first and second adjustable platforms, 18 and 19, respectively, is such that the entirety of each of the adjustable platforms is disposed within main platform 11. To prevent any undesired sliding of the adjustable platforms, adjustable platform fixing means may be provided. As shown in FIG. 3 in reference to first adjustable platform 18, such fixing means may include a pin 70, which extends through a hole 72 in top surface 20 of main platform 11 and a hole 74 in first adjustable platform 18. In this manner, pin 70 maintains a substantially fixed relationship between main platform 11 and first adjustable platform 18. Fixing means similar to that described above may be provided in relation to second adjustable platform 19.

At this point top structure 62 is removed from (or, alternatively, has not yet been placed on) the top of enclosure 42 so as to expose opening 60. Rigging or cables (not shown) is then attached to an end upright portion 64 or truss structure 46. Such rigging is attached at the other end thereof to lifting means, such as a crane, which is capable of lifting the entirety of moveable work platform assembly 10 sufficiently high so that, when it is suspended vertically, it can be inserted end first through opening 60. By "end first" it is intended to mean that the portion of truss structure 46 which includes end upright portion 64 enters through opening 60 first.

Moveable work platform assembly 10 is then lowered to the bottom of enclosure 42, the bottom of enclosure 42 being that portion adjacent pivot column 50. Once moveable work platform assembly 10 is resting on the bottom of enclosure 42 suspension means and any other desired rigging as described above or that may be known to those skilled in the art is attached to work platform assembly 10 and it is moved to a desired position within enclosure 42.

Once work platform assembly 10 has been moved to a desired vertical position within enclosure 42, such as, for example, through suspension means as described above, and, if desired, support means 52 have been tightened so that a substantially fixed position of main platform 11 to enclosure 42 is established first and second adjustable platforms, 18 and 19, respectively, may be extended. While the adjustable platforms may be moved outward by hand, it may be desirable, in some applications, due to the size of adjustable work platform assembly 10 and the need or desire for positive control over the movement of the adjustable platforms, to provide movement means. Such movement means are described, having reference to FIG. 3, in respect of first adjustable platform 18. It should be understood, however, that the structure and its method of operation which is described as follows is equally applicable to second adjustable platform 19.

A cable 80 is shown which extends from a crank 82, through pulley mens 84, down the length of main platform 11 to the end of first adjustable platform means 18 where it is fixed thereto through fixing means 86. In this way, as crank 82 is rotated by, for example, handle 88, cable 80 is taken up onto crank 82 which pulls first adjustable platform 18 in the direction of arrow "A". In this way, as can best be appreciated upon having reference to FIG. 1, end 39 of first adjustable platform 18 is moved toward inner wall 40 of enclosure 42. As described above, as first adjustable platform 18 is moved outward relative to main platform 11, the length of support cable 48 must be extended. This can be done through, for example, length adjustment means 53.

It will be apparent to those of ordinary skill in the art that various modifications and variations can be made to the above-described embodiments without departing from the scope of the appended claims and their equivalents.

What is claimed is:

1. A moveable work platform assembly capable of being suspended from an upper attachment assembly having a point attachment, comprising:

a platform assembly including a main platform and at least one adjustable platform for extending outward relative to said main platform and for retracting inward relative to said main platform a pivot disposed opposite said platform assembly from said attachment assembly;

a suspension assembly having one end fastened to the point of attachment and another end fastened to said platform assembly at spaced-apart points for suspending said platform assembly along an axis through said point of attachment and pivot;

a support assembly having one end attached to said platform assembly at spaced-apart points and another end, disposed along said axis, fastened to said pivot to support said platform assembly in alignment with said axis while permitting rotation about said axis.

2. A moveable work platform assembly for use within an enclosure having substantially non-vertical interior walls, the enclosure having an upper attachment assembly having a point of attachment at substantially the upper end thereof, comprising:

a platform assembly including a main platform and at least one adjustable platform for extending outward relative to said main platform toward the interior wall of the enclosure and for retracting inward relative to said main platform away from the interior wall of the enclosure;

a pivot disposed opposite said platform assembly from said attachment assembly;

a suspension assembly having one end pivotally fastened to the point of attachment and another end fastened to said platform assembly at spaced-apart points for suspending said platform assembly along an axis through said point of attachment and pivot; and a support assembly having one end attached to said platform assembly at spaced-apart points and another end, disposed along said axis, fastened to said pivot to support said platform assembly in alignment with said axis while permitting rotation about said axis.

3. A moveable work platform assembly as claimed in claim 1 or 2 which further includes an elevator for elevating and lowering said main platform relative to said upper attachment assembly.

4. A moveable work platform assembly as claimed in claim 1 or 2 including at least one roller means disposed between said adjustable platform and said main platform for rolling said adjustable platform inward and outward relative to said main platform.

5. A moveable work platform assembly as recited in claim 4 which further comprises:

first and a second adjustable platforms, first roller means disposed in said main platform for supporting said first adjustable platform and second roller means disposed in said main platform for supporting said second adjustable platform, said first adjustable platform being adjustable from a first position, wherein at least a part of said first adjustable platform is disposed within said main platform, to a second position, wherein said first adjustable platform is moved relative to said main platform and outward from the first position.

said second adjustable platform being adjustable from a first position, wherein at least a part of said second adjustable platform is disposed within said main platform, to a second position, wherein said second adjustable platform is moved relative to said main platform and outward from the first position.

6. A moveable work platform assembly means as recited in claim 5 wherein said main platform includes a top surface, said first roller means being disposed below said top surface at a first level and said second roller means being disposed at a second level below said first level.

7. A moveable work platform assembly as recited in claim 5 wherein said first and second adjustable platforms include first and second top surfaces and removable hand-rail means.

8. A moveable work platform assembly as claimed in claim 1 or 2 wherein said suspension assembly includes wire rope.

9. A moveable work platform assembly as claimed in claim 8 which includes a swivel disposed between said wire rope and said main platform for allowing said main platform to rotate relative to the upper attachment assembly.

10. A moveable work platform assembly as claimed in claim 9 which includes cable disposed between said swivel and said main platform.

11. A moveable work platform assembly as recited in claim 1 or 2 wherein said main platform includes a truss structure.

12. A moveable work platform assembly as claimed in claim 11 which includes support cables from said truss structure to said adjustable platform.

13. A moveable work platform assembly as claimed in claim 2 wherein the interior walls of the enclosure include support points and wherein support cables are provided and attached to said support points at one end thereof and to the main platform at the other end.

14. A moveable work platform assembly as recited in claim 1 or 2 further including a column to which said pivot is attached.

15. A moveable work platform assembly as recited in claim 14 wherein said column is disposed along an axis, said axis including said upper attachment assembly and said pivot.

16. A moveable work platform assembly as recited in claim 1 or 2 wherein said suspension assembly comprises cable.

17. A moveable work platform assembly as recited in claim 1 or 2 wherein said support assembly comprises cable.

* * * * *

UNITED STATES PATENT AND TRADEMARK OFFICE

CERTIFICATE OF CORRECTION

PATENT NO. : 5,301,770

DATED : April 12, 1994

INVENTOR(S) : Regan et al.

It is certified that error appears in the above-identified patent and that said Letters Patent is hereby corrected as shown below:

Item [76]

Inventors, Title page, line 2, after "Cockeysville" insert --, Md. 21030--.

Inventors, Title page, lines 3 and 4, change ",300 E. Joppa Rd. both of Towson, Baltimore, Md. 21204-3048" to --143 S. Meadow Dr., Glen Burnie, Md. 21060--.

Claim 1, column 9, line 38, change "platform a pivot" to --platform; a pivot--.

Signed and Sealed this

Thirtieth Day of August, 1994

*Attest:*

*Attesting Officer*

BRUCE LEHMAN

*Commissioner of Patents and Trademarks*